United States Patent [19]

Siffroi

[11] 4,370,637

[45] Jan. 25, 1983

[54] MAGNETIC ACTUATOR

[75] Inventor: Lucien Siffroi, Versailles, France

[73] Assignee: La Telemecanique Electrique, France

[21] Appl. No.: 135,377

[22] Filed: Mar. 31, 1980

[30] Foreign Application Priority Data

Mar. 30, 1979 [FR] France ..... 79 08029

[51] Int. Cl.[3] ..... H01H 9/00

[52] U.S. Cl. ..... 335/174; 335/258

[58] Field of Search ..... 335/174, 175, 176, 255, 335/251, 258, 262

[56] References Cited

U.S. PATENT DOCUMENTS 3,249,823 5/1966 Beardow ..... 335/258
3,783,423 1/1974 Mater et al. ..... 335/174
3,792,390 2/1974 Boyd ..... 335/174 X
3,984,795 10/1976 Gaskil ..... 335/174 X

FOREIGN PATENT DOCUMENTS 1279188 10/1968 Fed. Rep. of Germany ..... 335/251

*Primary Examiner*—George Harris
*Attorney, Agent, or Firm*—William A. Drucker

[57] ABSTRACT

An electromagnet has a movable core which is locked in rest position by magnetic effect. The movable core cooperates with portions of the magnetic field structure in such a manner as to form three sets of polar surfaces and gaps, of which one situated between the other two, can become saturated when the energizing flux of the winding achieves a certain threshold level. The device is particularly adapted to the actuation of circuit-breakers.

3 Claims, 4 Drawing Figures

MAGNETIC ACTUATOR

BACKGROUND OF THE INVENTION

This invention relates to an actuator, with magnetic attraction and locking, comprising an energising winding, and a movable core having a first portion which passes axially into the winding, a second portion and a third portion both external of the winding, and a magnetic field structure an element of which enters partially into the winding to present a first polar surface cooperating by an axial gap with the first portion, other elements of this magnetic field structure extending about the winding in order to form a second polar surface cooperating by a second radial gap with the second portion of the core, and to form a third polar surface cooperating with the third portion of the core by a third axial gap which is both small and precise.

THE PRIOR ART

An actuator in accordance with the above defined construction is known for example from Swiss Pat. No. 230351.

In this known device, the second polar surface of the magnetic field structure is placed between the first and third polar surfaces and the movable core is mounted on a sliding rod, made of a non-magnetic material, which serves to guide the core. The sliding rod comprises for this purpose an extension traversing the third polar surface. The magnetic locking is effected in a magnetic circuit comprising the first and third polar surfaces, by the cooperation between the third portion of the core and the third polar surface, this latter being adapted to become rapidly saturated, while the principal flux necessary for the movement of the core becomes closed across the first and second polar surfaces and across the first and second portions of the core.

These arrangements give rise, in operation, to a holding flux which is small and difficult to adjust and which, as a result, gives rise to wide variations of the unlocking threshold. These phenomena, which are observed as much with low winding currents as with large currents, are prejudicial when such actuators are to be used in circuit breakers in which one seeks to obtain a precise operation threshold and good limitation of short-circuit currents.

OBJECT OF THE INVENTION

It is accordingly the object of the invention to provide, in a device known in the prior art, some advances adapted to improve the unlocking threshold.

SUMMARY OF THE INVENTION

According to the present invention, this result is achieved in that the third portion of the core is disposed between the first portion and the second portion.

Complementary features, included for obtaining the same result when the currents circulating in the winding are high, will appear from the following description.

BRIEF DESCRIPTION OF THE DRAWINGS

In the drawings:

FIGS. $1_a$ and $1_b$ show in axial section a first manner of construction of the actuator and the core, and FIGS. $2_a$ and $2_b$ illustrate a second manner of construction of the actuator, and polar surfaces placed at the interior of the winding.

DESCRIPTION OF THE PREFERRED EMBODIMENT

Figure 1B:
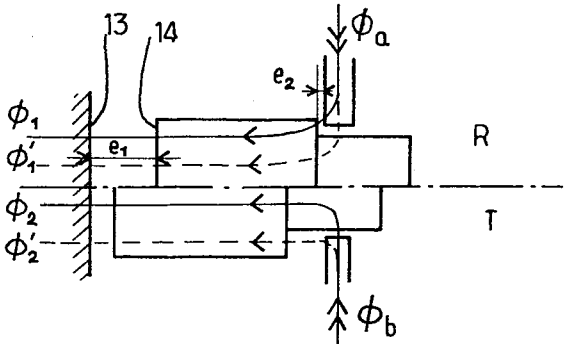

A magnetic actuator as shown in FIG. $1_a$ comprises a winding 1 disposed on a former 2 to constitute the excitation winding. A moving core 4 adapted to move axially at the interior of the bore 3 of the coil former is made of a magnetisable material and comprises a first portion 5 placed between the lateral face 14 and the broken line, a third portion 6 following on from the first portion and bounded by an annular radial surface 17, and a second portion 7 having a cylindrical diameter 20 less than that of the third portion 6 and following on therefrom.

A magnetic circuit structure cooperates with this winding and is formed by several successive elements. The first element 9 thereof enters partially into the interior of the bore and is bounded by its polar surface 13 perpendicular to the axis XX'. The other elements 10,11 and 12 extend from the first element and surround the winding, and the last body element 12 is directed towards the axis to form a polar surface 19 surrounding the second surface 22 of the portion 7 but leaving an annular gap 21, and an annular surface 16 directed towards the winding and placed perpendicularly to the axis XX'.

Two gaps 15 and 18 of respective widths $e_1$ and $e_2$ exist between the faces 13,14 and the faces 17,16 respectively.

A return spring (not shown) having a high elasticity tends to place the movable core in the positions shown in FIG. $1_a$ and in the upper region R of FIG. $1_b$.

The first body element 9 has a through passage 23 to receive a non-magnetic pusher element 24 which will transmit to an appropriate member the movement of the core towards the left hand side in this drawing and seen in the lower part T of FIG. $1_b$.

Figure 1A:
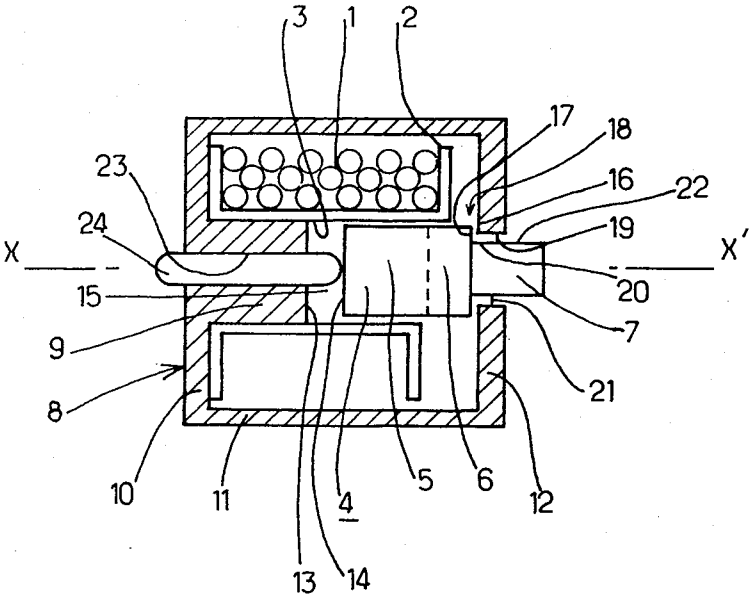
Figure 2B:
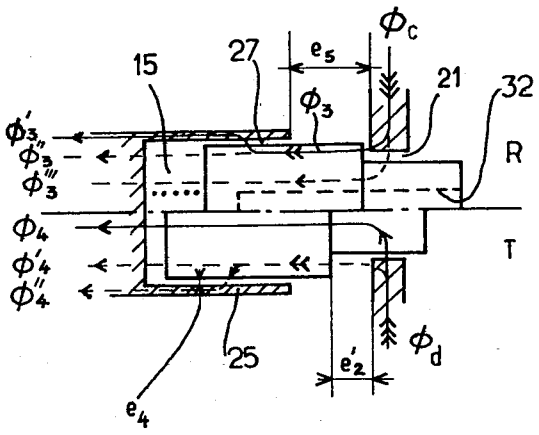
Figure 2A:
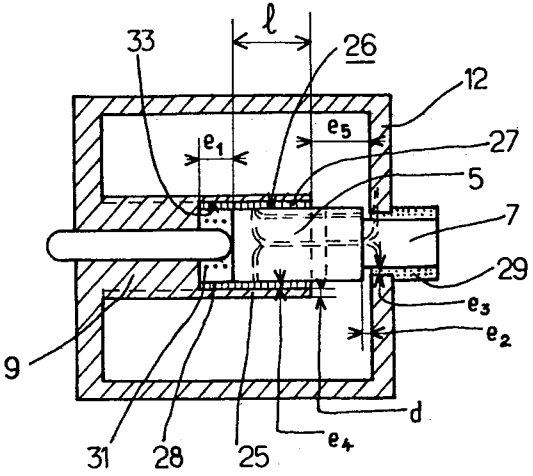

This device is dimensioned in such a manner that for a current intensity comprised between a nil value and a threshold value, the magnetic fluxes passing along the path $\phi 1$ and $\phi' 1$ (FIG. $1_b$) maintain the core towards the right hand side in the drawing by creating at 16 and 17 a force of attraction which is greater than that developed between the polar surfaces 13 and 14. For a certain intensity of current, a saturation appears at the polar surfaces 16 and 17 and the forces developed by the polar surfaces 13 and 14 becomes preponderant so that the core moves rapidly towards the left. In the course of this movement, the gap between 16 and 17 increases, while the gap between the polar surfaces 19 and 20 permits the fluxes $\phi 2$ to close themselves with small reluctance without creating parasitic axial attractions, see FIG. 1.

This device which provides an improvement of the locking force of the core in its position of FIG. $1_b$ R, likewise permits a more easy and more accurate adjustment of the gap 18 which is accompanied by a useful constancy of the locking force.

When high intensities are required to pass through the winding, it is necessary to have recourse to a further feature to increase the maintaining force without losing the benefits obtained by the device described above.

In FIG. $2_a$, wherein these further measures have been put into operation, the first portion 5 of the movable core is surrounded at least partially along a length l by a magnetisable cylindrical skirt 25 coupled concentrically to the first element 9 of the body, either by being in one piece therewith or by being fixed by fitting thereon, as shown in broken line. Between the internal surface 33 of this skirt and the external surface 26 of the first portion and of the third portion of the core there exists a gap 27 of width $e_4$. The width $e_4$ of this gap, as well as the polar surfaces which bound it, are disposed parallel with the gap 15 of width $e_1$ situated between 13 and 14.

In the state of rest of the core, obtained for example by the weak spring 31 seen in the portion R of FIG. $2_b$, the flux $\phi$3 traversing the polar surfaces 16 and 17 now takes up the path $\phi'$3 mainly passing through the gap 27 of width $e_4$ the reluctance of which is less than that of the gap 21, such that the maintaining force is improved; the fluxes $\phi''$3 and $\phi'''$3 are small compared with the flux $\phi'$3.

Furthermore, the skirt 25 has a thickness shown by *d* in FIG. $2_a$ the value of which is selected such that a saturation likewise appears here for a certain intensity of current circulating in the winding.

In the region T of FIG. $2_b$ corresponding to a movement of the core, it will be seen that the flux $\phi$4 has become preponderant compared with the secondary fluxes $\phi'$4 and $\phi''$4 passing through the gaps $e'_4$ and $e_4$.

A fifth gap $e_5$ existing between the frontal extremity of the skirt directed towards the body element 12, and the body element 12 itself, does not contribute to creating a force of attraction or of maintenance.

Nevertheless, the position of this latter gap parallel with the total fluxes $\phi$d and $\phi$c seen in FIG. $2_b$ permits the carrying out of certain adjustments by modifications of the length of the skirt which may extend up to the portion 12.

The gaps such as 27 of width $e_4$, and 21 of width $e_3$, may be provided by sleeves such as 28 and 29 which will be made of non-magnetic materials and the good frictional properties of which will permit them to be used, if necessary, to assure guiding of the core. To improve the speed of displacement of the core, its mass may be lightened by providing an internal cavity such as that shown at 32 in FIG. $2_b$.

I claim:

1. An actuator comprising:

(i) an energizing winding, (ii) a magnetisable core axially movable with respect to said winding into a rest position and a working position, said core including a first portion and a second portion and a third portion disposed axially between said first and third portions, said first portion being always within said winding and said second and third portions being at least partially externally of said winding when in said rest position, (iii) a magnetisable field structure adapted to become magnetised upon current flow in said energizing winding, said field structure including a portion positioned within the winding and presenting a first polar surface spaced, in the rest position of the core, by a first axial gap from the first core portion, said field structure extending about the winding and presenting a second polar surface spaced by a second and radial gap from said second portion of the core and a third polar surface spaced by a third and axial gap from said third portion of the core, said third gap being in the rest position of the core of less width than said first gap, said magnetisable core normally being held in said rest position by the magnetic flux passing through the second and third gaps, when the intensity of the said current flow is under a predetermined value, whereas the said magnetisable core is moved to the said second position by the magnetic flux passing through the first gap, as soon as the intensity of the said current flow exceeds the said predetermined value.

2. An actuator, as claimed in claim 1, wherein said first portion of the core is surrounded over at least part of its axial length by a magnetisable cylindrical skirt coupled to said portion of the field structure which is within the winding, a fourth and radial gap being defined between said skirt and said first portion of the core.

3. An actuator, as claimed in claim 1 or in claim 2, comprising non-magnetic bearing means disposed about and serving to guide said first and second portions of the core to ensure uniformity of the gaps which they bound.

* * * * *